US005328156A

United States Patent [19]

Hoke

[11] Patent Number: 5,328,156

[45] Date of Patent: Jul. 12, 1994

[54] SELF-ATTACHING FENCE TRIM GUARD

[76] Inventor: Edward J. Hoke, 1407 Woodoak Dr., Richardson, Tex. 75082

[21] Appl. No.: 948,176

[22] Filed: Sep. 21, 1992

[51] Int. Cl.[5] ..... E04H 17/00

[52] U.S. Cl. ..... 256/32; 256/1

[58] Field of Search ..... 256/1, 32, 33, 20; 47/33; 404/7, 8; 52/102

[56] References Cited

U.S. PATENT DOCUMENTS

| | | | |
|---|---|---|---|
| 2,805,013 | 9/1957 | Comfort . | |
| 3,110,066 | 11/1963 | Ward et al. . | |
| 3,384,351 | 5/1968 | Turner | 256/32 |
| 3,451,169 | 6/1969 | Arnold et al. . | |
| 3,713,624 | 1/1973 | Niemann . | |
| 3,768,780 | 10/1973 | Cowles | 256/1 |
| 3,788,001 | 1/1974 | Balfanz | 47/33 |
| 4,443,508 | 4/1984 | Mehl . | |
| 4,595,175 | 6/1986 | Kauffman | 256/1 |
| 4,663,883 | 5/1987 | Hilliard | 47/33 |
| 4,710,992 | 12/1987 | Falwell et al. . | |
| 4,907,783 | 3/1990 | Fisk et al. . | |
| 4,995,591 | 2/1991 | Humphrey et al. . | |
| 5,007,619 | 4/1991 | Sibeni . | |
| 5,039,065 | 8/1991 | Denton . | |
| 5,178,369 | 1/1993 | Syx | 256/1 |

*Primary Examiner*—Eric K. Nicholson
*Assistant Examiner*—Anthony Knight
*Attorney, Agent, or Firm*—Hubbard, Tucker & Harris

[57] ABSTRACT

A generally "U" shaped self adhering plastic extrusion is firmly fitted to the bottom portion of a chain link or wooden fence without fasteners. Upstanding walls of the elongated plastic body are tapered towards the center having a neck for accepting the fence and a curved bottom to provide a channel on each side to rapidly drain off water. The tapered walls grip the fence in frictional engagement to hold the body member in place. The assembly includes short coupler members shaped to slide longitudinally in close frictional engagement over the outer surface of the body members where abutting ends are found. Couplers help secure the body members in place and cover the joint. The raised central ridge running along the length of the bottom positions the edge protector with respect to the bottom of the fence and holds the bottom of the fence elevated above drainage channels to protect the fence from moisture or termite damage.

23 Claims, 2 Drawing Sheets

SELF-ATTACHING FENCE TRIM GUARD

BACKGROUND OF THE INVENTION

1. Field of the Invention

The present invention relates to a self-attaching trim guard for the bottom of a fence which facilitates removal of vegetation with a line trimmer and is installable on a pre-existing fence. The edge protector may be used on chain link or wooden type fences.

2. Description of the Prior Art

Fence edge trim protectors are disclosed in the prior art for placement along the bottom edge of a fence, particularly chain link fences, in order to stop the growth of vegetation up into the fence itself, to prevent a mower from striking the fence when mowing directly adjacent to it, or to reduce the tendency for the fence to break the cutting line of a string trimmer while at the same time allowing grass to grow right up near the bottom of the fence. These functions have not generally been combined.

Typically, the devices of both types are made flat to slide under the fence and then they are folded up around the fence and fastened. The necessity for folding portions of the device seriously undermines the cost effectiveness because a high quality plastic which is amenable to folding and bending is required and less expensive materials, such as recycled plastic, are generally precluded from use, even though edge trimming for a fence would be an ideal application for low quality recycled materials.

The type of device which prevents growth of grass and other types of vegetation underneath and in close proximity to a fence of which U.S. Pat. No. 5,039,065 is an example, functions by having a very wide base which also serves to support the wheels of a lawn mower and moves the growing edge of grass away from the fence. It is produced in the flat and requires severe bending in order to place it in position under and against the bottom edge of a fence.

The other type of device which is primarily useful for protecting the line trimmer is relatively narrow and is generally made from flat planar material with built-in fastener grooves as in U.S. Pat. No. 4,907,783. After sliding under the bottom edge of the fence, the device is folded up on either side and fasteners are placed through the openings in the fence to connect each of the fastener grooves that are formed in the flat structure prior to being used.

Because this device is relatively narrow in width at the bottom, the grass can grow up close to the edge of the fence and yet be readily trimmed without damaging a line trimmer. Severe folding from a flat to a U-shaped configuration is required during use. The narrow type of device also has the advantage that it can pass by the intermediate posts in a chain link fence without a distortion or a special structural modification to accommodate the space occupied by the posts.

The wide bottom type of structure necessarily must accommodate the post generally by custom cutting or mitering modifications which are labor intensive and greatly increase the cost of installation. The pieces must necessarily terminate at each of the corner and intermediate posts; otherwise, the posts themselves would prevent installation. This further increases the costs by reducing the maximum length that can be used and requiring a joint at each post. In both types of edge protectors, the joints are unsightly, especially in the wide bottom structure, because there are so many of them.

SUMMARY OF THE INVENTION

An improved fence guard edge trim protector is provided with the emphasis on ease of installation, improved appearance at the joints, and economical mass production with the ability to use the absolute least expensive recycled plastic materials of varying quality. Of particular significance is the fact that the trim guard is self-attaching in the sense that it holds itself in position on the fence by frictional engagement with the fence without the need for separate time-consuming labor intensive fasteners to hold it in place. The trim guard edge protector has the further characteristic that the device has a specially shaped body member with built-in elongated longitudinally extending drain channels in order to allow any water entering through an open neck at the top of the structure from accumulating to where it can cause freeze damage or contribute to rotting of the bottom edge of a wooden fence. The longitudinally extending drain channels are formed as opposing lobes which extend the width of the bottom and provide a widened footprint which provides support and reduces the tendency for vegetation to grow directly under the fence. It has a centrally located longitudinally extending ridge in the bottom between the lobes for positioning the lower edge of the fence, especially a wooden fence, a controlled distance above the drain channels in order to prevent deterioration by water. Water can rapidly escape through the drain channels to eliminate freeze damage without the necessity of having openings for accumulated water to escape.

The self-attaching edge protector further includes extruded coupler members for covering the joint between abutting ends of adjacent body members to cover unsightly joints and provide a more secure installation by increasing the gripping force. Use of couplers makes it possible to produce the elongated body members in the most convenient length to have the most economical production, installation and shipping cost. The coupler members have an internal cross-sectional surface profile to match an external surface profile of the body members so as to slip over the body members in close frictional engagement therewith. The coupler members preferably have a smaller height than the body members leaving an upper portion of the neck of the body members extending above the neck portion of the coupler members. This makes it possible to extrude the body members with a cross-sectional profile in the upper portion of the neck which extends above the matching neck profile of the coupler members. The thickened portion can provide greater resistance to bending in the vicinity of where each coupler member is located. In this way, the gripping power of the body members is increased rather than decreased where joints between abutting body sections are present. Still further, matching cross-sectional surface profiles of the body members and couplers may include grooves and ribs to help hold the coupler members in place. The matching grooves and ribs preferably comprise longitudinally running ribs extending from the outer surface of the body members and corresponding longitudinally running grooves on the inner surface of the coupler members to engage the ribs and help position and hold the coupler members in place on the body members. In one embodiment, the corresponding grooves and ribs may have an angular cross-sectional profile and in another embodiment, they may have a smooth cross-sectional profile. In still another embodiment, the surface profiles have no grooves and ribs.

The coupler members simply slide over the end of the body members and hide them from view. Since the ribs are preferably located on the outer surface of the body members, the wall thickness is not reduced and they retain sufficient gripping strength to grip the fence, even though the wall is relatively thin. The body members and couplers may preferably be extruded from recycled PVC (polyvinyl chloride) with a uniform wall thickness of approximately 0.05" to 0.07" to produce a stiff, yet somewhat resilient, part which can be spread apart so that the side portions can receive and grip the fence. Alternately, the coupler members can be cut from an extruded length of a different plastic.

In order to install the body members, they can be placed with the neck opening in contact with the bottom edge of the fence and simultaneously spread and rotated under the bottom edge so that the body member is rotated into an upright position. Alternately, the body member can be slid in an upright position from the corner edge of the fence to gradually receive the bottom edge of the fence as the body member is longitudinally advanced along under the fence. The coupler members can be rotated under the edge of the fence and slid longitudinally over the end of one body member already installed. The other body member can then be slid longitudinally into the open end of the coupler member to complete a butt joint.

DETAILED DESCRIPTION OF THE PREFERRED EMBODIMENT

Figure 1:
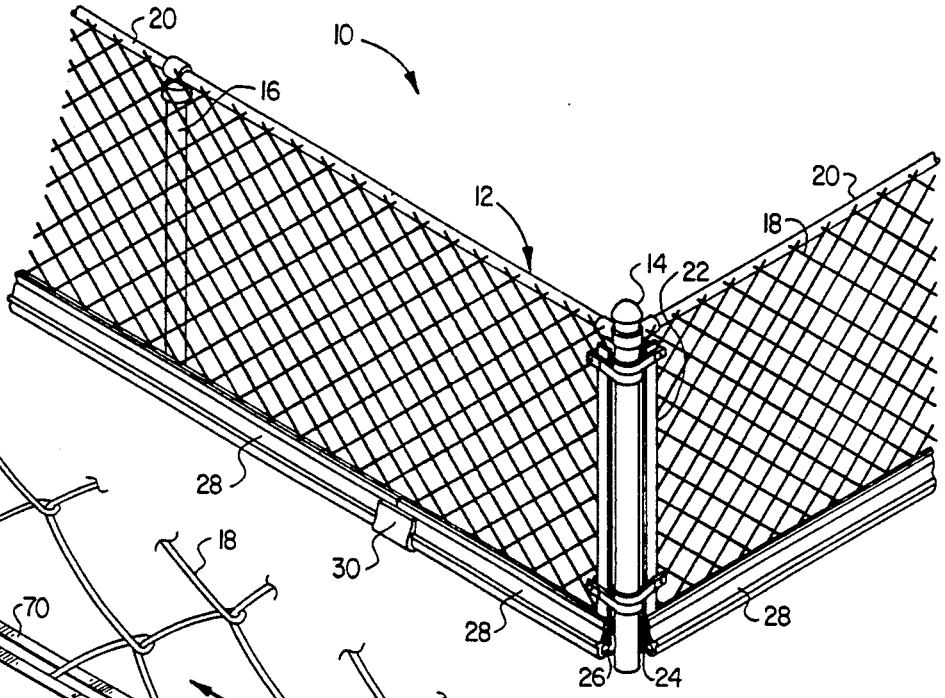
FIG. 1 is a perspective view of a chain link fence showing the fence trim edge protector in operative position on the bottom edge of the fence with a butt joint covered by a connector member.

A completed self-attaching fence edge protector assembly 10 in FIG. 1 is installed on the bottom edge of a conventional chain link fence. The chain link fence is generally designated by the reference numeral 12 having a corner post 14 at one corner and an intermediate post 16. The chain link fence fabric 18 is interconnected between posts to form a flat fence extending in both directions away from the corner post and supported at the top by rail 20. At the corner post, the ends of the fence are connected by means of clamps 22 which stretch the fence between the corner posts and adjacent to the intermediate posts 16. One side of the fence has a bottom edge 24 in FIG. 1 and the other side of the fence has a bottom edge 26. Posts 14,16 are mounted in the ground to support the fence.

In gripping engagement with bottom edge 24 is an elongated body member 28 which may run from corner post to corner post if it is made long enough. In gripping engagement with bottom edge 26 is a short section of body member 28 having one end adjacent the corner post and the opposite end abutting a longer body member 28 wherein the body members are aligned along bottom edge 26 and connected by coupler member 30. Body members 28 are elongated shaped resilient plastic body members formed by extrusion from economical plastic resin.

Figure 2:
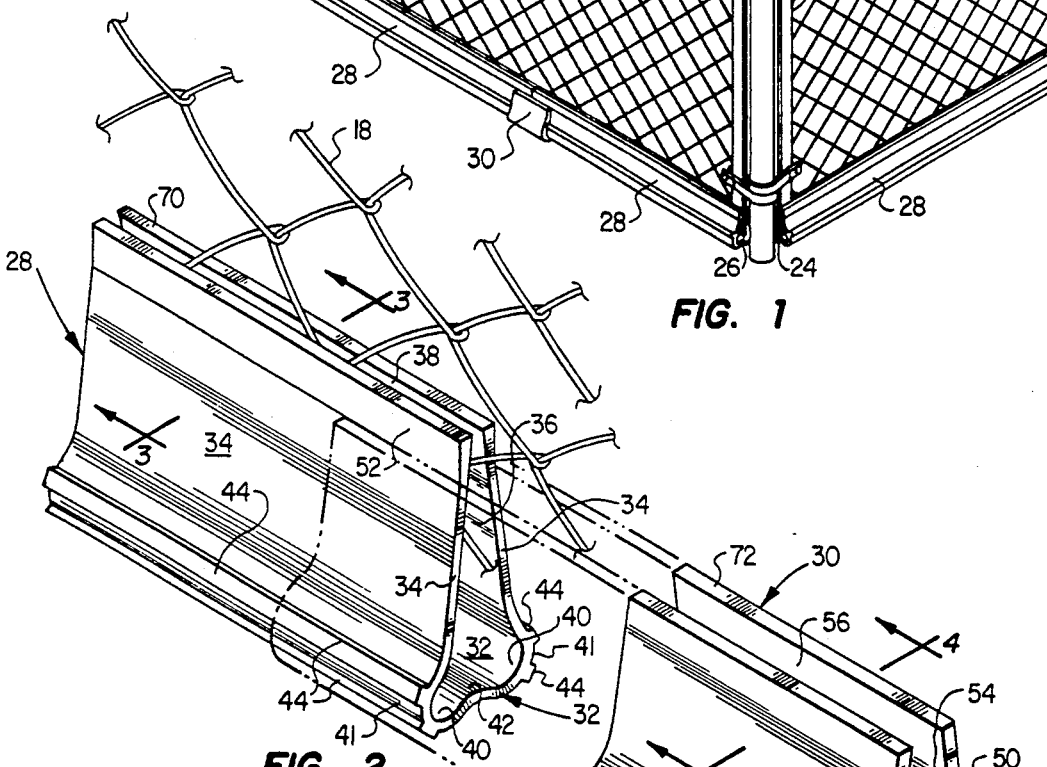
FIG. 2 is an exploded view of a body member and connector member with the body member in position at the bottom of a chain link fence.

FIG. 2 is an exploded view of a body member 28 and a corresponding coupler member 30. Body member 28 has a closed rounded bottom wall portion designated 32 and inwardly angled upstanding opposed side wall portions 34 extending from the bottom and terminating in an open narrow neck portion 36 having opening 38 at the uppermost end 70 of upstanding sides 34. Neck portion 36 is adapted for gripping the bottom edge portion of a fence so that the bottom edge of the fence can be inserted into the neck through opening 38 with the side portions 34 spread apart in gripping engagement with the fence to hold the body member in position without fasteners.

Figure 3:
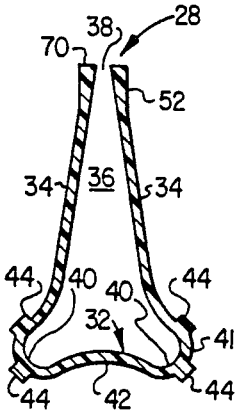
FIG. 3 is a cross-sectional profile of the body member having ribs on the outside surface with angular edges.

Body member 28 is seen in cross section in FIG. 3 without being installed on the bottom edge of the fence. The closed bottom wall 32 is formed to have one or more longitudinally extending drain channels 40 arranged on either side of a longitudinally extending ridge 42. The longitudinally extending drain channels allow any water entering through the neck to rapidly escape out the ends in order to prevent deterioration or freeze damage caused by water. Longitudinally running ribs 44 extend from the outer surface of the body member 28 and are received in matching longitudinally running grooves 46 shown in the cross sectional profile of the coupler member in FIG. 4.

In FIG. 2, it can be seen that body member 28 has an external cross-sectional surface profile which comprises the outer surface of the body member and the coupler member 30 has an internal cross-sectional surface profile which comprises the inside surface of the coupler member which matches the external surface profile of the body member so as to slip over the body members in close frictional engagement therewith. This is indicated by the phantom lines in FIG. 2 showing how the surface profiles match when the coupler member is slipped over the end of a body member.

Coupler member 30 has a closed bottom wall 48 which on the inside is shaped like the outside of bottom wall 32 of body member 28. Coupler member 30 has upstanding side walls 50 which are shaped to have the inside surface profile fit against the outside of side walls 34. However, the upstanding side walls 50 of coupler 30 do not extend upwardly as far as the side walls 34 which have an upper portion 52 of neck portion 36 which extend above the end 72 of matching neck profile 54 of coupler 30 which terminates at opening 56. The upper portion 52 of side walls 34 are thickened to provide greater resistance to bending in the vicinity of where a coupler member may be located.

Figure 4:
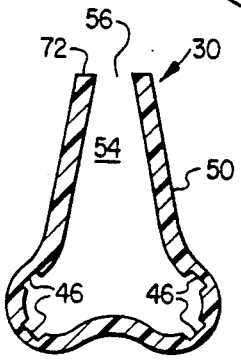
FIG. 4 is a cross-sectional profile of the corresponding coupler member having cooperating grooves with angular edges which receive the external ribs of the body member shown in FIG. 3.
Figure 5:
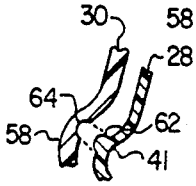
FIG. 5 is a partial cross-sectional view of the wall of the body member and coupler member showing a rib and groove having rounded surfaces.

The drain channels of the body members may be described as opposed longitudinally extending lobes 41 arranged on either side of the longitudinally extending ridge 42. Coupler 30 has lobes 58 in bottom 48 on either side of raised ridge 60 wherein the inner surface of the coupler member matches the outer surface of the body member to slide on the end in close frictional engagement. The coupler adds stiffness and rigidity to abutting ends of adjacent body members and covers most of the joint. The matching lobes extend the width of the bottom preferably to more than twice the external width of the neck to provide a better footing for the bottom and discourage the growth of vegetation directly under the fence. In FIGS. 3 and 4 the grooves in coupler 30 and the ribs on body 28 have angular cross-sectional profiles which match. FIG. 5 shows an alternate arrangement of the ribs and grooves with ribs 62 extending from the outer surface of lobes 41 and grooves 64 on the inner surface of lobes 58 of body member 28 and coupler 30. The ribs and grooves are preferably as shown but they could be reversed with the body member having the grooves. This would tend to reduce the wall thickness and gripping power unless suitable wall thickness compensation were provided.

Figure 6:
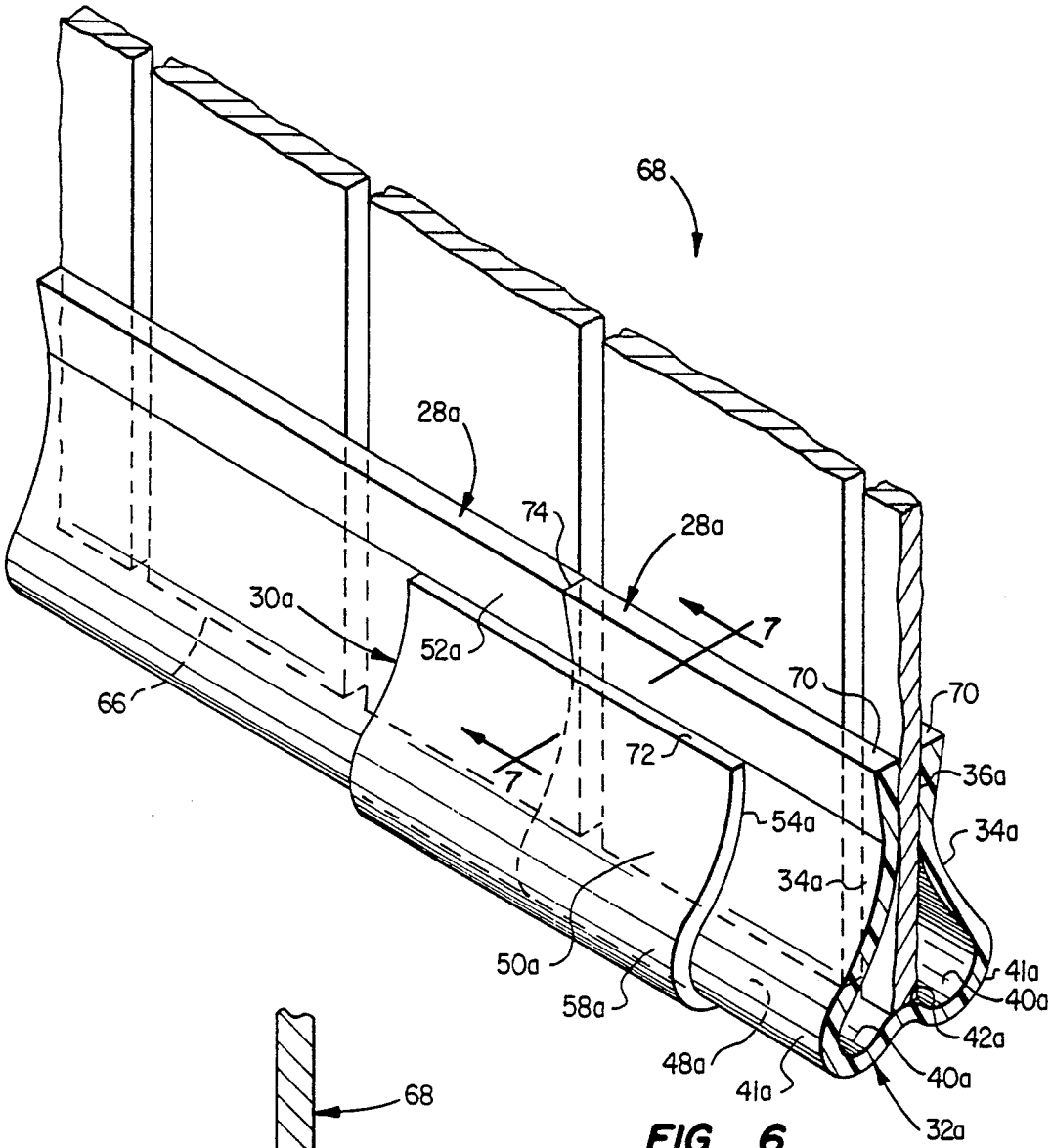
FIG. 6 is a perspective view of a joint between abutting ends of adjacent body members and a coupler member having smooth external and internal surfaces as applied to the lower edge of a wooden fence.
Figure 7:
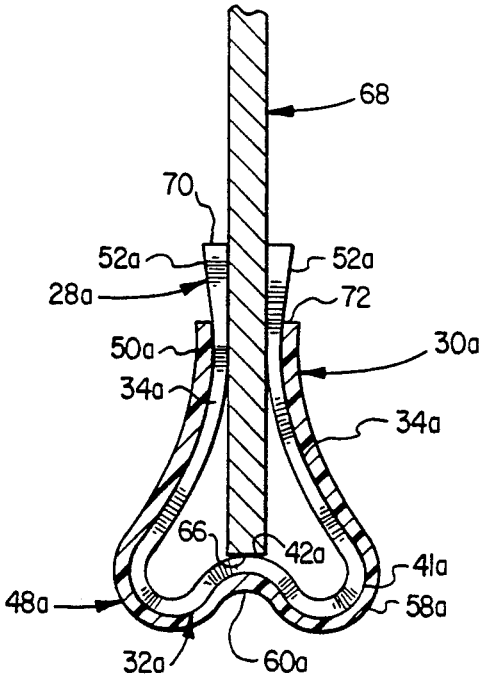
FIG. 7 is a cross section through the coupled body member and fence of FIG. 6.

FIGS. 6 and 7 show the use of the invention as applied to the bottom of a conventional wooden board fence which shows how the longitudinally extending central ridge positions the lower edge of the fence a controlled distance above the drain channels in order to prevent deterioration from any accumulated moisture. In this modification, the longitudinally extending ribs in the body members and the longitudinally extending matching grooves in the coupler member have been removed. Bottom edge 66 of fence 68 rests on longitudinally extending ridge **42*a* of body member 28*a* and an abutting adjoining body member 28*a*. Body member 28*a* has opposed drain channels 40*a* separated by ridge 42*a* in closed bottom wall 32*a*. The drain channels 40*a* are formed in opposed lobe portions 41*a* formed as part of bottom wall 32*a*. Inwardly angled upstanding side wall portions 34*a* extend from bottom 32*a* and terminate at ends 70 to form open narrow neck 36*a* adapted for being spread apart and gripping the bottom edge of the boards of the fence so that the boards can be inserted in the opening between ends 70 through the neck down into bottom 32*a* to rest on ridge 42*a*. The sides of the neck 36*a*** grip the fence to hold the body members in place.

Coupler member **30*a* has an internal cross-sectional surface profile that matches the cross-sectional outer surface profile of the body members 28*a*. Coupler 30*a* has a lobed bottom wall 48*a* with an internal surface that matches lobed bottom wall 32*a*. Lobes 58*a* surround lobes 41*a*. Central longitudinal ridge 60*a* in bottom wall 48*a* conforms to the shape of the central longitudinally extending ridge 42*a* in the body members. Inwardly angled upstanding side portions 50*a* of coupler 30*a* match side portions 34*a* of body members and fit in close frictional engagement therewith. Sides 50*a* terminate at ends 72 with a narrow neck 54*a* that fits over and supports the outer surface of the neck portion of body members 28*a* which form neck 36*a*. As before, body members 28*a* have an upper portion 52*a* in the neck extending above end portion 72 of the neck of the coupler member which are thickened and provide additional gripping engagement further supported by the gripping engagement of coupler member 30*a* at joints 74**.

In FIG. 7, the cross-sectional view of FIG. 6 is shown with the bottom edge 66 of fence 68 resting on centralized elongated longitudinally running ridge **42*a* of body member 28*a*. The inside surface profile of coupler member 30*a* closely matches and corresponds with the outer surface profile of body member 28*a*** and is similarly spread apart to provide clamping force which tends to hold the coupler in close frictional engagement against the outside surface of the body members.

The coupler is preferably installed by spreading it slightly and sliding it longitudinally over a previously installed body member **28*a* so that half is on either side of butt joint 74** which is formed when the other adjacent abutting longitudinally extending body member is slid into the other half of the coupler member.

In operation, the body members may be installed by spreading them to admit the fence into the neck opening and then sliding them longitudinally from a corner along the bottom edge of the fence into the operating position. Ultimately, it can be installed as the fence is being constructed simply by placing it in frictional engagement with the bottom of a chain link fence which is to stretch between end posts or placing it in position and lowering one or more starter boards of a wooden fence into the neck opening which holds it in position as additional boards are added. Alternately still, the body member can be turned so that the neck opening is in contact with the bottom edge of the fence and then forced into position by gradually rotating the body member into an upright position as the bottom edge of the fence slides further and further into the neck opening. This latter procedure requires a small amount of space below the bottom edge of the fence.

Usually, a chain link fence has ties to the upright poles which can be loosened or removed temporarily so that the edge can be pulled away to insert the body members over the edge. A similar technique is used to insert the coupler members provided they are produced with enough springiness to temporarily yield in order to rotate them into place by placing the open neck of the coupler member against one of the lobes of the body member and rotate it into position. The coupler members are preferably placed on the bottom edge of the fence in the same manner as the body members in an area where the body members have not yet been placed and then moved longitudinally to place them over the ends of adjoining body members which are slid longitudinally together to form a butt joint in the middle of the coupler.

It is contemplated that the invention is ideally suited to the use of recyclable PVC materials from ground up plastic containers or combinations of plastic to provide the requisite economy and stiffness. Although the plastic is described as resilient, it is preferably flexible only to a limited extent with some force applied. A fairly stiff construction is preferred to enhance the gripping action of the neck. As a chain link fence is about ⅝" wide, the neck must be adapted to accommodate that size. The preferable wall thickness of the body members is about 0.06" with a preferred range of about 0.05"–0.07" and the entire assembly is preferably about 4" high. It is contemplated that the coupler wall win be about the same thickness as the body member, although it could be made thicker as long as the inside surface profile matches the body member. It is further contemplated that the body members and couplers of FIG. 6 could be roll formed from flat pieces of galvanized metal, such as steel.

It can be seen that the smooth surface of the trim guard prevents breakage of the plastic line used with the typical so-called flexible line trimmers that are used for edging. They are easily broken in contact with the wire fence. As the bottom of the assembly is several inches wide, it tends to discourage grass and weeds from growing up through the fence which is a common problem with all types of fences. It is to be emphasized that no fasteners are required to hold the fence trim edge protector in place, and thus, it may be said to be self-attaching. It is useful to prevent termites or moisture damage from deteriorating the bottom edge of wooden fences. Termites can't easily get in or out and air circulation through the ends dries any moisture which does not run out.

I claim:

1. A self attaching fence trim edge protector installable on a pre-existing fence, comprising:

an elongated shaped resilient plastic body member formed by extrusion;

the body member having an interior surface and an exterior surface and a closed bottom and inwardly angled upstanding opposed side portions extending from the bottom and terminating in an open narrow neck portion adapted for gripping the bottom edge portion of a fence so that the bottom edge of a fence can be inserted into the neck with the side portions spread apart in gripping engagement with the fence to hold the body member in position without fasteners, and a short extruded coupler member for covering said exterior surfaces of the joint between abutting ends of adjacent body members and extending along said closed bottoms.

2. The self attaching fence protector of claim 1 wherein the coupler member has an internal cross-sectional surface profile to match an external surface profile of the body members so as to slip over the body members in close frictional engagement therewith.

3. The self attaching fence protector of claim 2 wherein the body members in the upper portion of the neck extend above a matching neck profile of the coupler member.

4. The self attaching fence protector of claim 3 wherein the cross-sectional profile of the body members in the upper portion of the neck extending above the matching neck profile of the coupler member is thickened to provide greater resistance to bending in the vicinity of where a coupler member is located.

5. The self attaching fence protector of claim 3 wherein the matching cross-sectional surface profiles of the body members and coupler have matching grooves and ribs to help hold the coupler in place.

6. The self attaching fence protector of claim 5 wherein the matching grooves and ribs comprise longitudinally running ribs extending from the outer surface of the body members and corresponding longitudinally running grooves on the inner surface of the coupler member to engage said ribs and help position and hold the coupler member in place on the body members.

7. The self attaching fence protector of claim 6 wherein the corresponding grooves and ribs have an angular cross-sectional profile.

8. The self attaching fence protector of claim 6 wherein the corresponding grooves and ribs have a smooth cross-sectional profile.

9. A self attaching fence trim edge protector installable on a pre-existing fence, comprising:

an elongated shaped resilient plastic body member formed by extrusion;

the body member having a closed bottom and upstanding opposed side portions extending from the bottom and terminating in an open narrow neck portion adapted for being spread apart to receive the bottom edge portion of a fence so that the side portions of the body member grip the bottom edge portion of the fence to hold the body member in position without fasteners;

the closed bottom being formed to have one or more longitudinally extending drain channels to allow water to rapidly escape and a longitudinally extending ridge for positioning the lower edge portion of a fence above said drain channels to prevent deterioration and freeze damage caused by water; and a short coupler member for covering the joint between abutting ends of adjacent body members, the coupler member having an internal cross-sectional surface profile to match an external surface profile of the body member so as to slip over and engage the body member, or the abutting ends of two body members, in close frictional engagement with the coupler member.

10. The self attaching fence trim edge protector of claim 9 wherein said drain channels are opposed longitudinally extending lobes arranged on either side of said longitudinally extending ridge.

11. The self attaching fence trim edge protector of claim 10 wherein said opposed lobes are enlarged portions of the closed bottom which extend the width of the bottom to more than twice the external width of the neck to provide a better footing for the body and discourage the growth of vegetation directly under the fence.

12. The self attaching fence trim edge protector of claim 11 wherein the outer surface of the lobes has at least one longitudinally extending rib projecting outwardly for engaging one or more complementary longitudinally extending grooves in the inner surface of the coupler member.

13. The self attaching fence trim edge protector of claim 12 wherein said plastic body members have an overall wall thickness in the area below the thickened neck portion of about 0.05 to 0.07 inches.

14. A self attaching fence trim edge protector installable on a preexisting fence, comprising:

an elongated shaped resilient plastic body member formed by extrusion;

the body member having a closed bottom and inwardly angled upstanding opposed side portions extending from the bottom and terminating in an open narrow neck portion adapted for gripping the bottom edge portion of a fence so that the bottom edge of a fence can be inserted into the neck with the side portions spread apart in gripping engagement with the fence to hold the body member in position without fasteners;

the closed bottom formed to have one or more longitudinally extending drain channels in order to allow any water entering through the neck to rapidly escape in order to prevent deterioration or freeze damage caused by water; and the inside of the bottom having a longitudinally extending ridge for positioning the lower edge of a fence a controlled distance above said drain channels in order to prevent deterioration.

15. The self attaching fence trim edge protector of claim 14 wherein said drain channels are opposed longitudinally extending lobes arranged on either side of said longitudinally extending ridge.

16. The self attaching fence trim edge protector of claim 15 wherein said opposed lobes are enlarged portions of the closed bottom which extend the width of the bottom to more than twice the external width of the neck to provide a better footing for the body and discourage the growth of vegetation directly under the fence.

17. The self attaching fence trim edge protector of claim 15 wherein the outer surface of the lobes has at least one longitudinally extending rib projecting outwardly for engaging one or more complementary longitudinally extending grooves in the inner surface of a coupler member.

18. A self attaching fence trim edge protector installable on a preexisting fence, comprising:

an elongated shaped resilient plastic body member formed by extrusion;

the body member having a closed bottom and inwardly angled upstanding opposed side portions extending from the bottom and terminating in an open narrow neck portion adapted for gripping the bottom edge portion of a fence so that the bottom edge of a fence can be inserted into the neck with the side portions spread apart in gripping engagement with the fence to hold the body member in position without fasteners;

the closed bottom formed to have one or more longitudinally extending drain channels in order to allow any water entering through the neck to rapidly escape in order to prevent deterioration or freeze damage caused by water; and a short extruded coupler member for covering the joint between abutting ends of adjacent body members.

19. The self attaching fence trim edge protector of claim 18 wherein the coupler member has an internal cross-sectional surface profile to match an external surface profile of the body member so as to slip over the body member in close frictional engagement therewith.

20. The self attaching fence trim edge protector of claim 19 wherein the body member in the upper portion of the neck extends above a matching neck profile of the coupler member.

21. The self attaching fence trim edge protector of claim 20 wherein the cross-sectional profile of the body member in the upper portion of the neck extending above the matching neck profile of the coupler member is thickened to provide greater resistance to bending in the vicinity of where a coupler member is located.

22. The self attaching fence trim edge protector of claim 21 wherein the matching cross sectional surface profiles of the body member and coupler have matching complimentary grooves and ribs comprising longitudinally running ribs extending from the outer surface of the body member and corresponding longitudinally running grooves on the inner surface of the coupler member to help position and hold the coupler in place on the body member.

23. The self attaching fence trim edge protector of claim 22 wherein said plastic body members have an overall wall thickness in the area below the thickened neck portion of about 0.05 to 0.07 inches.

* * * * *